US008616291B2

(12) United States Patent
Smith et al.

(10) Patent No.: US 8,616,291 B2
(45) Date of Patent: Dec. 31, 2013

(54) FAIL SAFE REGULATOR FOR DEEP-SET SAFETY VALVE HAVING DUAL CONTROL LINES

(75) Inventors: Roddie R. Smith, Cypress, TX (US); Donnie R. Clapp, Katy, TX (US)

(73) Assignee: Weatherford/Lamb, Houston, TX (US)

( * ) Notice: Subject to any disclaimer, the term of this patent is extended or adjusted under 35 U.S.C. 154(b) by 404 days.

(21) Appl. No.: 12/890,056

(22) Filed: Sep. 24, 2010

(65) Prior Publication Data

US 2012/0073829 A1 Mar. 29, 2012

(51) Int. Cl.
*E21B 34/10* (2006.01)

(52) U.S. Cl.
USPC ..... 166/375; 166/324

(58) Field of Classification Search
USPC ..... 166/375, 374, 386, 319, 321, 324, 166/332.8; 137/112, 119.01; 251/26
See application file for complete search history.

(56) References Cited

U.S. PATENT DOCUMENTS

| | | | |
|---|---|---|---|
| 4,621,695 | A | 11/1986 | Pringle |
| 4,838,355 | A | 6/1989 | Leismer et al. |
| 4,945,993 | A | 8/1990 | Dickson et al. |
| 4,951,753 | A | 8/1990 | Eriksen |
| 4,986,357 | A | 1/1991 | Pringle |
| 5,058,682 | A | 10/1991 | Pringle |
| 5,310,004 | A | 5/1994 | Leismer |
| 5,947,206 | A | 9/1999 | McCalvin et al. |
| 6,003,605 | A | 12/1999 | Dickson et al. |
| 6,148,843 | A | 11/2000 | Pringle |
| 6,173,785 | B1 | 1/2001 | Adams et al. |
| 6,237,693 | B1 | 5/2001 | Deaton |
| 6,302,210 | B1 | 10/2001 | Crow et al. |
| 6,491,106 | B1 | 12/2002 | Simonds |
| 6,502,640 | B2 | 1/2003 | Rayssiguier et al. |
| 6,505,684 | B2 | 1/2003 | Rayssiguier et al. |
| 6,513,594 | B1 | 2/2003 | McCalvin et al. |

(Continued)

FOREIGN PATENT DOCUMENTS

| | | | |
|---|---|---|---|
| RU | 2181426 | C1 | 4/2002 |
| RU | 2243361 | C2 | 12/2004 |
| RU | 2353826 | C2 | 4/2009 |
| SU | 1588861 | A1 | 8/1990 |

OTHER PUBLICATIONS

"Paintball Pressure Regulators," obtained from www.docsmachine.com/tech/regs.html, generated on Sep. 13, 2010, 3 pages.

(Continued)

*Primary Examiner* — Nicole Coy
(74) *Attorney, Agent, or Firm* — Wong, Cabello, Lutsch, Rutherford & Brucculeri, LLP

(57) ABSTRACT

A hydraulic control system for a sub-surface safety valve has control lines in hydraulic communication with the valve. A first control line communicates hydraulic pressure to actuate the valve, while the other control line communicates hydraulic pressure to compensate for hydrostatic pressure associated with the first control line. A regulator regulates hydraulic communication between the two control lines. The regulator prevents fluid communication from the first to the balance control line as long as integrity of the second line is maintained. When the second line fails, the safety valve can fail in the open position. In this case, the regulator permits hydraulic pressure to bleed from the first line to the second line. This allows the safety valve to then fail in a closed condition and allows the second line to potentially be recharged if its integrity is regained.

29 Claims, 5 Drawing Sheets

(56) References Cited

U.S. PATENT DOCUMENTS

| | | | | |
|---|---|---|---|---|
| 6,523,613 | B2 | 2/2003 | Rayssiguier et al. | |
| 6,626,244 | B2 | 9/2003 | Powers | |
| 7,246,668 | B2 | 7/2007 | Smith | |
| 7,392,849 | B2 | 7/2008 | Lauderdale et al. | |
| 7,434,626 | B2 | 10/2008 | Vick, Jr. | |
| 7,637,324 | B2 * | 12/2009 | Anderson et al. | 166/323 |
| 7,654,333 | B2 | 2/2010 | Smith | |
| 7,878,252 | B2 * | 2/2011 | Smith et al. | 166/375 |
| 2002/0046845 | A1 | 4/2002 | Rayssiguier et al. | |
| 2003/0155131 | A1 | 8/2003 | Vick, Jr. | |
| 2005/0087335 | A1 | 4/2005 | Vick, Jr. | |
| 2005/0269103 | A1 | 12/2005 | Vick, Jr. | |
| 2006/0196669 | A1 | 9/2006 | Lauderdale et al. | |
| 2007/0068680 | A1 | 3/2007 | Vick, Jr. | |
| 2008/0066921 | A1 | 3/2008 | Bane et al. | |
| 2008/0128137 | A1 | 6/2008 | Anderson et al. | |
| 2008/0314599 | A1 | 12/2008 | Bane et al. | |
| 2009/0071777 | A1 | 3/2009 | Weber et al. | |
| 2010/0116502 | A1 | 5/2010 | Anderson | |

OTHER PUBLICATIONS

Decision on Grant in counterpart Russian Appl. No. 201139127, dated Dec. 4, 2012.

First Office Action in counterpart Canadian Appl. No. 2,752,336, dated Feb. 6, 2013.

Examination Report received in corresponding Australian Appl. No. 2011224003, dated Apr. 16, 2013.

* cited by examiner

FAIL SAFE REGULATOR FOR DEEP-SET SAFETY VALVE HAVING DUAL CONTROL LINES

BACKGROUND

Subsurface safety valves, such as a tubing retrievable safety valves, deploy on production tubing in a producing well. The safety valves can selectively seal fluid flow through the production tubing if a failure or hazardous condition occurs at the well surface. In this way, safety valves can minimize the loss of reservoir resources or production equipment resulting from catastrophic subsurface events.

A conventional safety valve uses a flapper to close off flow through the valve. The flapper, which is normally closed, can be opened when hydraulic pressure applied to a hydraulic piston move a flow tube against the bias of a spring in the valve. When the flow tube moves, it pivots the flapper valve open, allowing flow through the safety valve.

From the surface, a control line supplies the hydraulic pressure to operate the valve. The control line extends from a surface controlled emergency closure system, through the wellhead, and to the safety valve. As long as hydraulic pressure $P_C$ is applied through the control line, the valve can remain in the opened position, but removal of control line pressure returns the valve to its normally closed position. The hydrostatic or "head" pressures $P_H$ from the column of fluid in the control line can directly limit the setting depth and operational characteristics of the safety valve in such a system.

Historically, additional load from stronger power springs has been used to offset the hydrostatic pressure of the control line. However, safety valves have limited space available to accommodate a larger spring. In fact, the active control line hydrostatic pressure $P_H$ can be so significant in some applications that a spring may not be able to overcome the hydrostatic pressure and the valve's flapper cannot close, assuming the wellbore pressure is zero.

To compensate for the control line's hydrostatic pressure $P_H$, a gas (nitrogen) charge can be stored in the safety valve to counteract the hydrostatic pressure. Unfortunately, using a gas charge in the valve presents problems with leakage of the gas, which can cause the valve to fail in the open position. In addition, once the charge is spent in a fail-safe operation, operators must do a substantial amount of work to replace the valve.

In contrast to a gas charge, safety valves have been developed that use a magnetically driven device on the valve. The magnetic device allows the hydraulics to reside outside the wellbore and may use annulus pressure to offset the hydrostatic pressure of the control line so that the safety valve can be set at greater depths. Unfortunately, using such an arrangement may be undesirable in some applications.

In yet another solution, a second "balance" control line has been used with a deep-set safety valve to negate the effect of hydrostatic pressure $P_H$ from the active control line. In these existing balance line valves, the second balance line acts on the valve's piston against the pressure from the active control line to balance the hydrostatic pressure $P_H$ from the active control line Therefore, because the underside of the piston is in fluid communication with the balance line, the piston is no longer in fluid communication with the tubing. Accordingly, any beneficial effect produced by the tubing pressure $P_T$ in operating this type of deep-set safety valve is not utilized.

A different type of balance line arrangement shown in FIG. 1 is disclosed in U.S. Pat. No. 7,392,849, which is assigned to the Assignee of the present disclosure and is incorporated herein in its entirety. Production tubing 20 has a deep-set safety valve 50 for controlling the flow of fluid in the production tubing 20. In this example, the wellbore 10 has been lined with casing 12 with perforations 16 for communicating with the surrounding formation 18. The production tubing 20 with the safety valve 50 deploys in the wellbore 10 to a predetermined depth. Produced fluid flows into the production tubing 20 through a sliding sleeve or other type of device. Traveling up the tubing 20, the produced fluid flows up through the safety valve 50, through a surface valve 25, and into a flow line 22.

As is known, the flow of the produced fluid can be stopped at any time during production by switching the safety valve 50 from an open condition to a closed condition. To that end, a hydraulic system having a pump 30 draws hydraulic fluid from a reservoir 35 and communicates with the safety valve 50 via a first control line 40A. When actuated, the pump 30 exerts a control pressure $P_C$ through the control line 40A to the safety valve 50.

Due to vertical height of the control line 40A, a hydrostatic pressure $P_H$ also exerts on the valve 50 through the control line 40A. For this reason, a balance line 40B also extends to the valve 50 and provides fluid communication between the reservoir 35 and the valve 50. Because the balance line 40B has the same column of fluid as the control line 40A, the outlet of the balance line 40B connected to the valve 50 has the same hydrostatic pressure $P_H$ as the control line 40A.

Internally, components of the safety valve 50 are exposed to control pressure $P_C$ from the control line 40A and the offsetting hydrostatic pressure $P_H$ from the balance line 40B. Yet, the components are also exposed to tubing pressure $P_T$ in the well during operation, which can be beneficial. As briefly illustrated in FIGS. 2A-2B, the deep-set safety valve 50 uses the hydraulic pressures from the two control lines (40A-B) so the valve 50 can be set at greater depths downhole. The valve 50 as illustrated in FIGS. 2A and 2B has first and second actuators 60A-B. The first actuator 60A has an active piston 62A coupled to a flow tube 54. Control pressure from the primary control line (40A) moves the control piston 62A and the flow tube 54 against the bias of a spring 56 to open the valve's flapper (not shown). The second actuator 60B has a balance piston 62B that can intermittently engage the flow tube 54 during operation.

In FIG. 2A, the valve 50 is in a closed condition where the balance piston 62B is idle in which case the tubing pressure $P_T$ is greater than the hydrostatic pressure $P_H$. By contrast, the valve 50 is in an opened condition in FIG. 2B. As shown in FIG. 2A, if the tubing pressure $P_T$ is substantial, then force from this tubing pressure $P_T$ and from the spring 56 exerts on the control piston 62A and tends to close the valve 50. Since the tubing pressure $P_T$ is greater than $P_H$ in FIG. 2A, however, the balance piston 52B is idle as it exerts no force on the flow tube 54 because a net downward force exerted by the tubing pressure $P_T$ keeps the balance piston 62B resting on a shoulder 57.

As shown in FIG. 2B, if the hydrostatic pressure $P_H$ is substantial, a force exerts on the control piston 62A and tends to open the valve 50. Likewise, control pressure $P_C$ from the control line (40A) exerts on the control piston 62A and tends to open the valve 50. Yet, the hydrostatic pressure $P_H$ exerts an opposing force on the balance piston 62B, thereby tending to close the valve 50. Additionally, the tubing pressure $P_T$ exerts an opposing force on the balance piston 62B; however, this force does not tend to open the valve 50 because the balance piston 62B is structurally isolated from the flow tube 54 (and the spring 56) by interaction of a block 55 with the shoulder 57 of the chamber housing. Thus, if the control pressure $P_C$ is reduced in FIG. 2B, the valve 50 will revert to the closed condition shown in FIG. 2A.

Although existing safety valves for deep-set applications may be effective, operators are continually seeking improved hydraulic control systems for deep-set applications that can avoid failures and mitigate other problems. The subject matter of the present disclosure is directed to overcoming, or at least reducing the effects of, one or more of the problems set forth above.

SUMMARY

A hydraulic control system for a sub-surface safety valve has first and second control lines in hydraulic communication with the sub-surface safety valve. The first control line communicates first hydraulic pressure to actuate the sub-surface safety valve. The second control line communicates second hydraulic pressure to compensate for hydrostatic pressure associated with the first control line. A regulator regulates hydraulic communication between the first and second control lines. The regulator can affix to production tubing and can be plumbed between the two control lines downhole. Alternatively, the regulator can be installed on or incorporated into the safety valve itself or some other tubing component downhole.

In general, as long as the second hydraulic pressure compensates for the hydrostatic pressure in the first control line, the safety valve can operate appropriately. In this case, the regulator prevents fluid communication from the first control line to the second control line. However, when the second hydraulic pressure falls below a particular level related to the hydrostatic pressures associated with the first control line, the safety valve can fail in the open position depending on the pressure in the well. In this case, the regulator permits hydraulic communication from the first control line to the second control line. As hydraulic pressure bleeds from the first line to the second line, the hydraulic pressure from the first line may fall below a particular level. Assisted by the spring (and potentially by tubing pressure as well), the safety valve can then fail in the closed condition instead of remaining open. Eventually, the hydraulic pressure bled from the first control line may charge the second control line if the second line's integrity is regained. In this way, the safety valve can then be reset.

The first control line extends from the sub-surface safety valve uphole through a wellhead, where the first control line couples to a hydraulic system, having a pump and reservoir. The second control line can also extend from the sub-surface safety valve up through the wellhead and can couple to a pump or a reservoir of the hydraulic system. Alternatively, the second control line extends from the sub-surface safety valve, but it terminates at some point downhole from the wellhead. In this case, the second control line can have a cap. When the production tubing with the safety valve and control lines is deployed downhole, the second control line may be evacuated of hydraulic fluid. Once deployed, hydraulic pressure can be bled from the first control line to the second control line through the regulator to an appropriate pressure for the deep-set operation of the safety valve. Any trapped gas in the second control line can then be used as a compressible buffer for the line, which may be advantageous for its operation.

The foregoing summary is not intended to summarize each potential embodiment or every aspect of the present disclosure.

DETAILED DESCRIPTION

Figure 1:
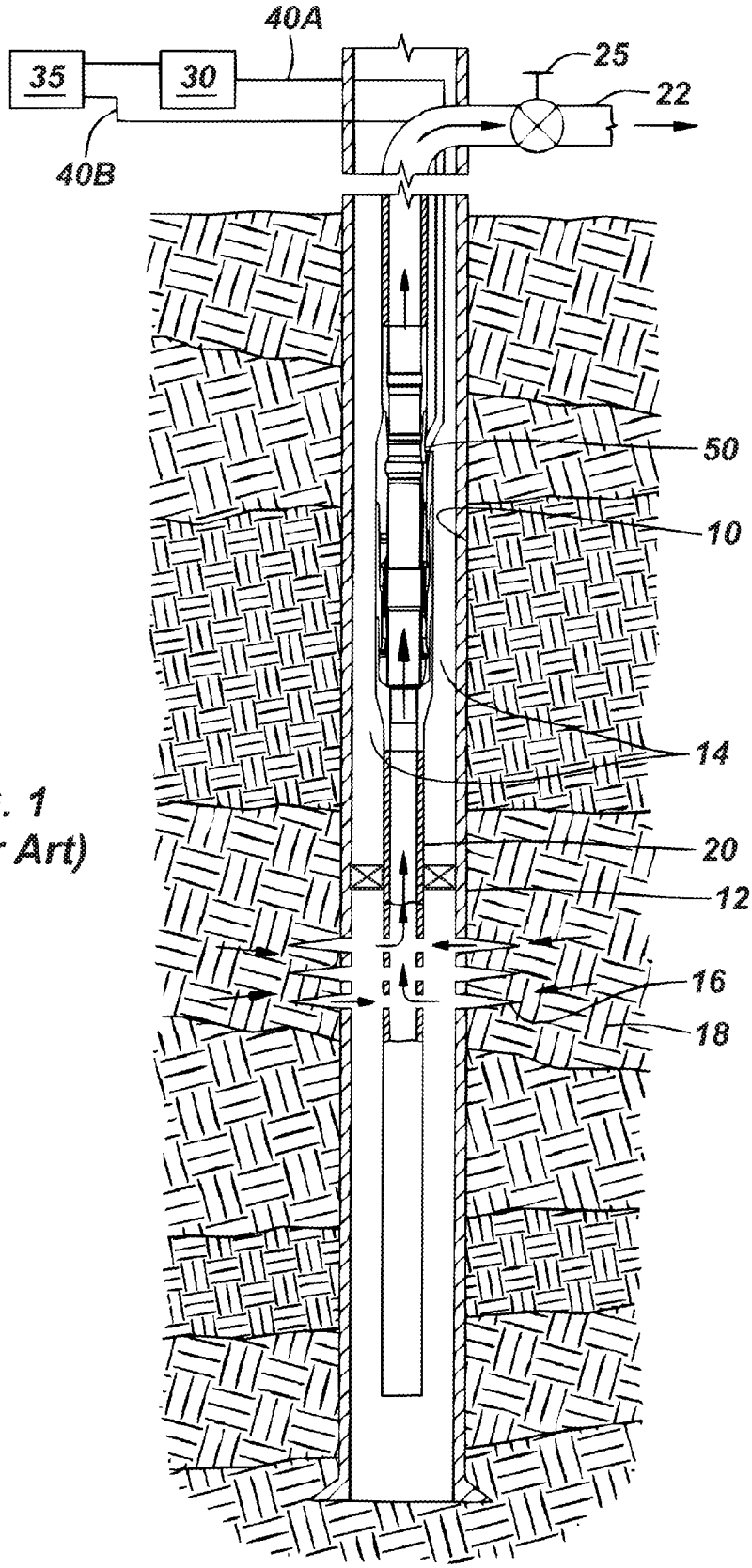
FIG. 1 (Prior Art)
FIG. 1 illustrates a wellbore having a string of production tubing and a deep-set safety valve in accordance with the prior art.
Figure 2B:
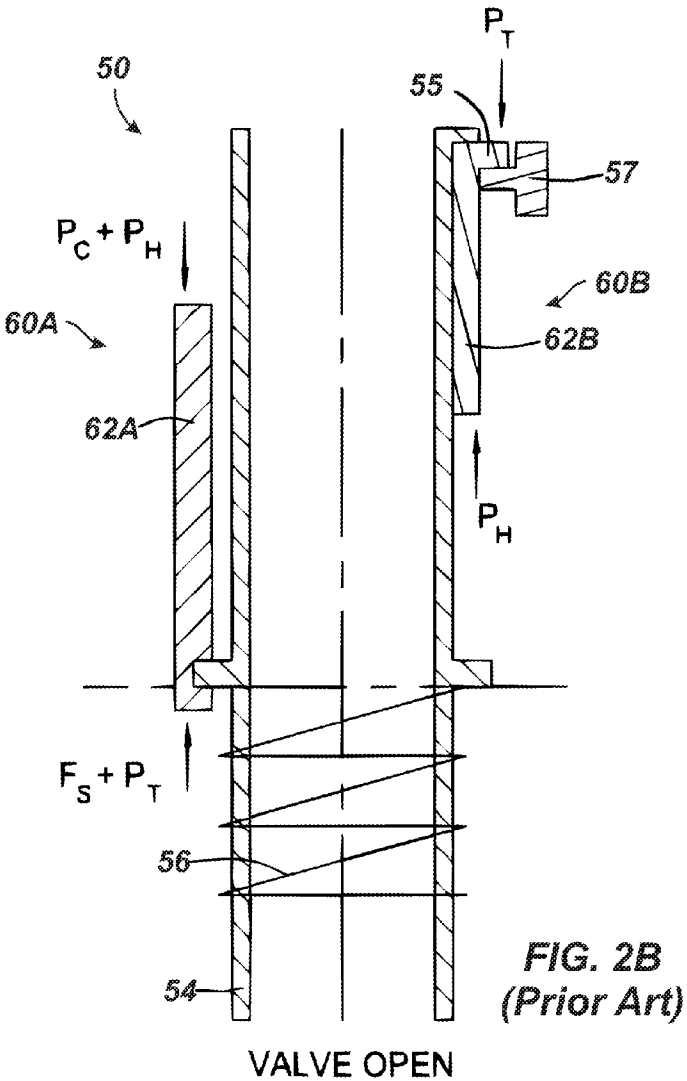
FIG. 2B (Prior Art)
FIGS. 2A-2B illustrate details of the deep-set safety valve of the prior art.
Figure 2A:
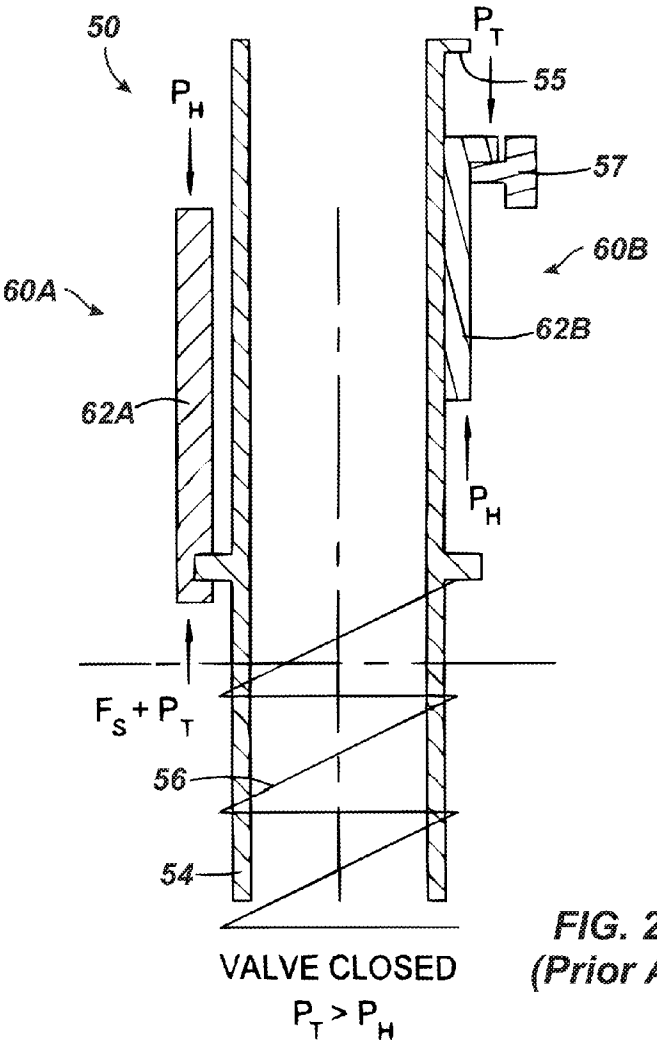
FIG. 2A (Prior Art)
Figure 3A:
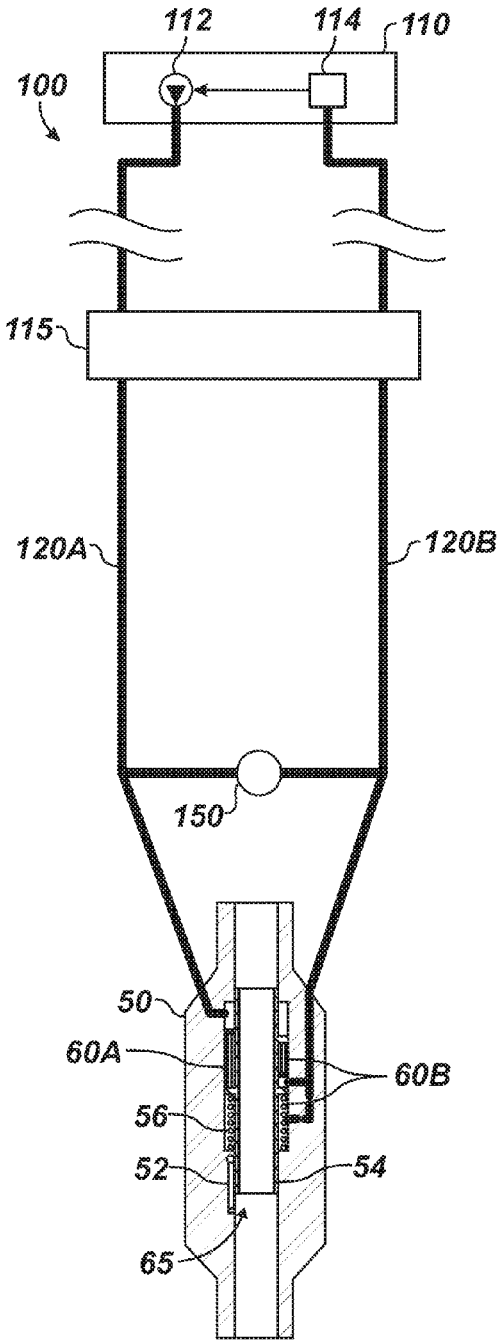
FIGS. 3A-3C illustrate configurations of a control system in accordance with the present disclosure for a deep-set safety valve.
Figure 3B:
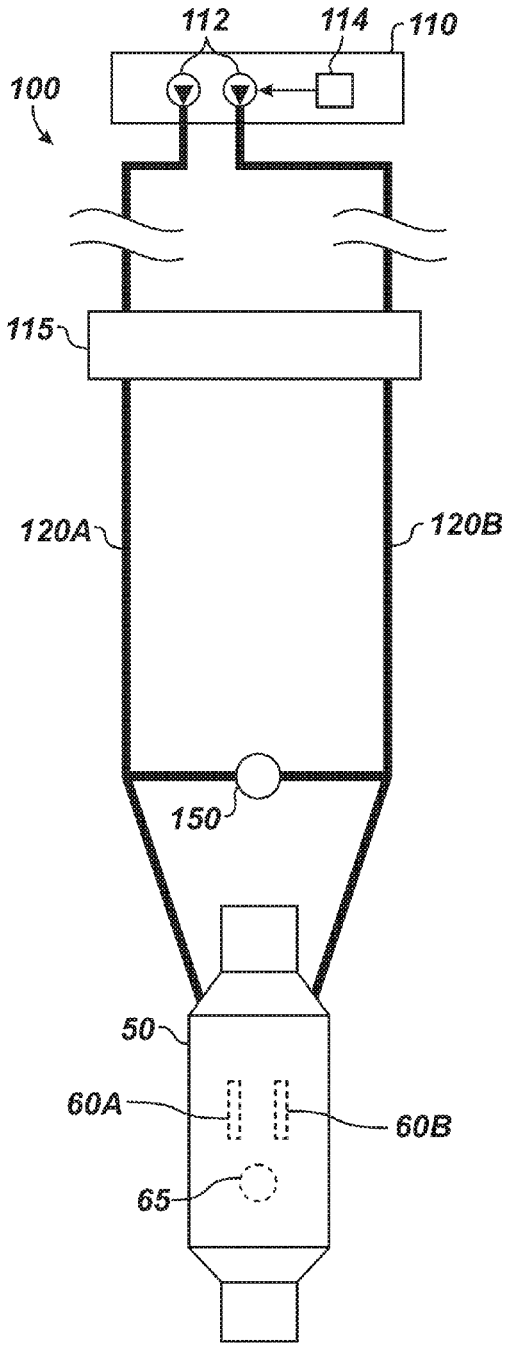
Figure 3C:
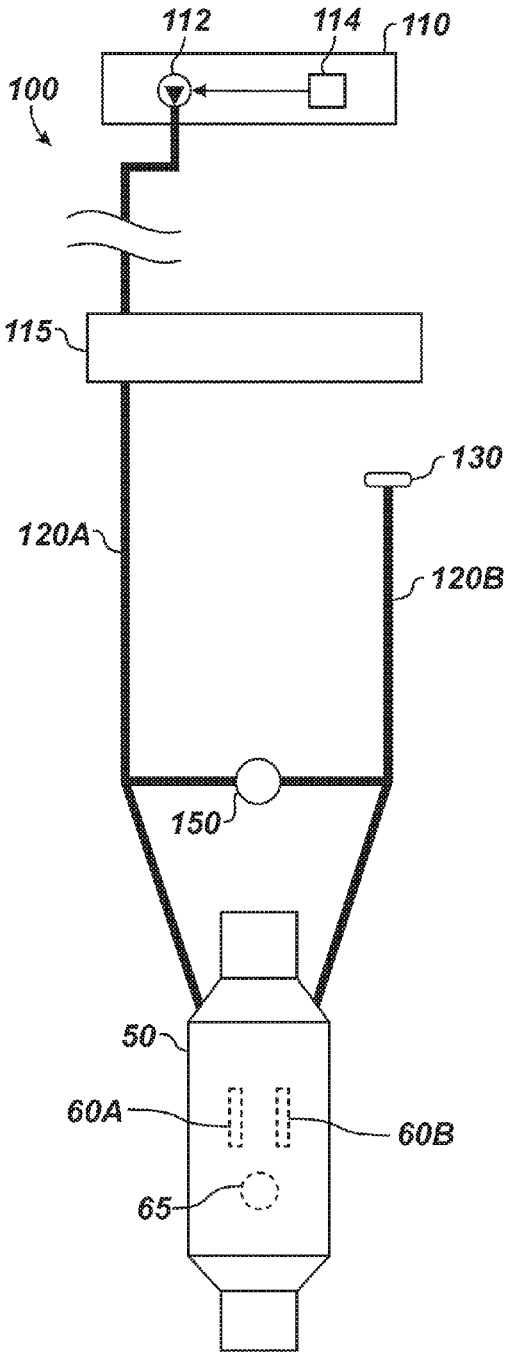

A dual line control system 100 in FIGS. 3A-3C operates with a deep-set safety valve 50. As described previously, the safety valve 50 installs on production tubing (not shown) disposed in a wellbore, and the safety valve 50 controls the uphole flow of production fluid through the production tubing. In use, the safety valve 50 closes flow through the tubing in the event of a sudden and unexpected pressure loss or drop in the produced fluid, which coincides with a corresponding increase in flow rate within the production tubing. Such a condition could be due to the loss of flow control (i.e., a blowout) of the production fluid. During such a condition, the safety valve 50 automatically actuates and shuts off the uphole flow of production fluid through the tubing. When control is regained, the safety valve 50 can be remotely reopened to reestablish the flow of production fluid.

The control system 100 includes a well control panel or manifold of a hydraulic system 110, which can have one or more pumps 112, reservoirs 114, and other necessary components for a high-pressure hydraulic system used in wells. In FIG. 3A, two control lines 120A-B extend from the hydraulic system 110 through the wellhead 115 and down the well to the deep-set safety valve 50. One of the control lines 120A couples to the pump 112 of the hydraulic system 110, while the other control line 120B couples to the reservoir 114 of the hydraulic system 110 in a manner similar to that described in U.S. Pat. No. 7,392,849, which has been incorporated herein by reference in it its entirety.

In FIG. 3B, two control lines 120A-B extend from the hydraulic system 110 through the wellhead 115 and down the well to the deep-set safety valve 50. In this configuration, however, both control lines 120A-B couple to the one or more pumps 112 of the hydraulic system 110 and are separately operable. Using this configuration, operators can open and close the deep-set safety valve 50 in both directions with hydraulic fluid from the control lines 120A-B being separately operated with the hydraulic system 110. Either way, the balance control line 120B in FIGS. 3A-3B can offset the hydrostatic pressure in the primary control line 120A, allowing the safety valve 50 to be set at greater depths.

Passing control lines through the components of the wellhead 115 can be complicated. As another alternative, the configuration of the control system 100 in FIG. 3C has the balance control line 120B terminated or capped off below the wellhead 115. Thus, only the primary control line 120A runs to the surface and the hydraulic system 110, while the balance control line 120B for offsetting the hydrostatic pressure terminates below the wellhead 115 with a cap 130. In this way, the configuration of FIG. 3C eliminates the need for passing two control lines through the wellhead 115.

For its part, the safety valve 50 in FIGS. 3A-3C can include any of the deep-set valves known and used in the art. In one implementation, the deep-set safety valve 50 can have features such as disclosed in incorporated U.S. Pat. No. 7,392,849. In general, the deep-set safety valve 50 uses hydraulic pressures from the two control lines 120A-B to actuate a closure 65 of the valve 50 so the valve 50 can be set at greater depths downhole. As best shown in FIG. 3A, for example, the primary or active control line 120A can operate a primary actuator 60A in the valve 50, while the second or balance control line 120B can operate a second actuator 60B. As shown, the closure 65 can include a flapper 52, a flow tube 54, and a spring 56. The primary actuator 60A can include a rod piston assembly known in the art for moving the flow tube 54. The balance actuator 60B can also include a rod piston assembly known in the art for moving the flow tube 54.

Alternatively, the balance actuator 60B can include the balance control line 120B communicating with a chamber for the spring 56 so second hydraulic pressure in the balance control line 120B can act in conjunction with the spring 56 against the flow tube 54. Moreover, the balance control line 120B can communicate with an opposing side of the piston assembly of the first actuator 60A to balance the hydrostatic pressure in the first control line 120A. Alternatively, the control lines 120A-B can couple to actuators in the safety valve 50 in accordance with the arrangement disclosed in incorporated U.S. Pat. No. 7,392,849, which allows tubing pressure to be utilized. These and other actuators 60A-B and closures 65 can be used in the safety valve 50 for the disclosed control system 100.

Either way, with the primary control line 120A charged with hydraulic pressure, the primary actuator 60A opens the closure 65. For example, the piston of the actuator 60A moves the flow tube 54 down, which opens the flapper 52 of the safety valve 50. For its part, the hydraulic pressure from the balance control line 120B offsets the hydrostatic pressure in the primary control line 120A by acting against the balance actuator 60B. For example, the balance actuator 60B having the balance piston assembly acts upward on the flow tube 54 and offsets the hydrostatic pressure from the primary control line 120A. Therefore, this offsetting negates effects of the hydrostatic pressure in the primary control line 120A and enables the valve 50 to operate at greater setting depths.

If the balance control line 120B loses integrity and insufficient annular pressure is present to offset the primary control line's hydrostatic pressure, then the valve 50 can fail in the open position, which is unacceptable. The control line 120B, which may be %-inch diameter tubing, can fail due to various reasons. For example, the control line 120B can leak, or it can become contaminated or blocked over time due to debris in the control fluid. Typical debris, contamination, or particles that can develop and become suspended in the control fluid can come from reservoirs, physical wear of system components, chemical degradation, and other sources.

To overcome unacceptable failure, the control system 100 includes a fail-safe device or regulator 150 disposed at some point down the well. The regulator 150 interconnects the two control lines 120A-B to one another and acts as a one-way valve between the two lines 120A-B. Under certain circumstances discussed later, the regulator 150 bleeds pressure from the primary control line 120A to the balance control line 120B to facilitate operation of the safety valve 50.

Figure 4A:
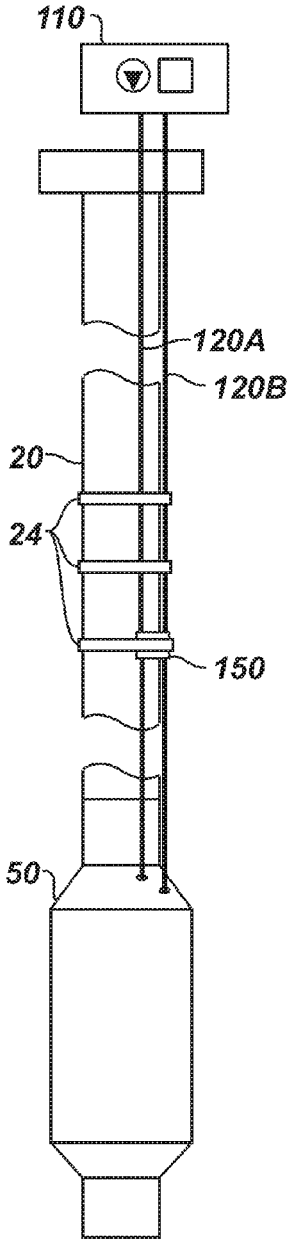
FIGS. 4A-4B illustrate configurations for affixing the control system on production tubing having a deep-set safety valve.
Figure 4B:
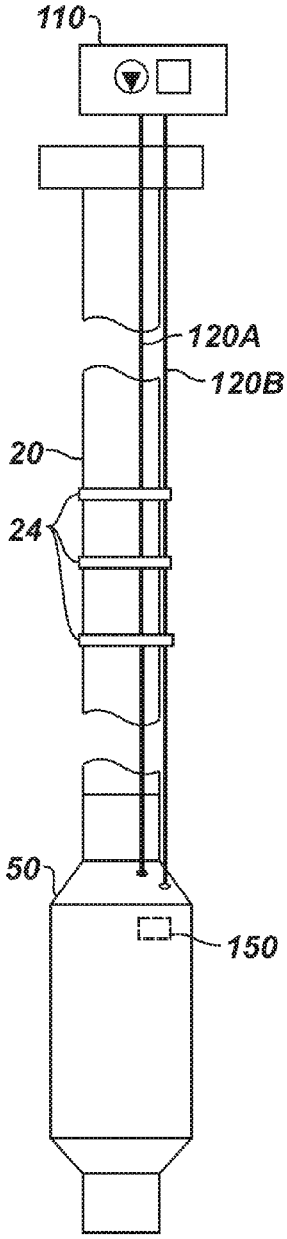

Briefly, FIG. 4A shows an arrangement for affixing the control lines 120A-B to production tubing 20 having the deep-set safety valve 50. The control lines 120A-B can use straps or bandings 24 typically used to attach control lines to tubing. The regulator 150 can be an independent component coupled by flow tees or other necessary components to the control lines 120A-B and can also affix to the tubing 20 with bandings 24. Alternatively, as shown in FIG. 4B, the regulator 150 can be installed on or incorporated into the housing of the safety valve 50 or some other tubing component downhole, while the control lines 120A-B affix with bandings 24 or the like. The banding and other arrangements can be used to install the control system 100 on the tubing 20.

As noted previously, the configurations in FIGS. 3A-3B have the control lines 120A-B pass through the wellhead 115 using known techniques. For the configuration in FIG. 3C, however, the balance control line 120B is terminated downhole with a cap 130 using capping techniques known in the art. The depth at which the balance control line 120B is capped can vary depending on the implementation. In practice, the balance control line 120B is intended to provide an offset of the hydrostatic pressure in the primary control line 120A.

When deploying the control system 100 of FIG. 3C downhole, the balance control line 120B is preferably evacuated of hydraulic fluid. As the lines 120A-B are lowered with the tubing 20, the primary control line 120A bleeds hydraulic pressure into the balance control line 120B through the regulator 150, which allows pressure flow from the line 120A to 120B (but not from 120B to 120A). As hydraulic pressure builds in the balance line 120B, an amount of trapped gas forms in the line 120B, which is beneficial for the operation of the control system 100. For example, this trapped gas acts as a compressible buffer and can help avoid vapor lock in the system 100.

In any of the configurations of FIGS. 3A-3C, if the balance control line 120B line is ever lost, the regulator 150 can bleed hydraulic pressure from the primary line 120A to the balance control line 120B to achieve any of the various purposes disclosed herein. Details of the regulator 150 for the control system 100 are shown in FIGS. 5A-5B.

Figure 5A:
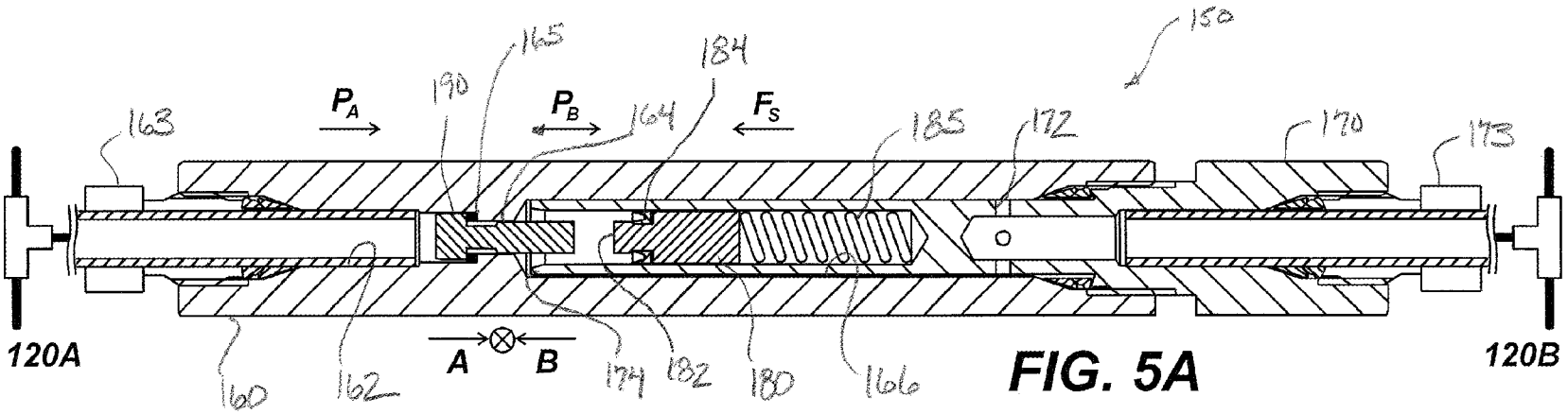
FIGS. 5A-5B illustrate cross-sections of a regulator in closed and opened conditions for the disclosed control system.
Figure 5B:
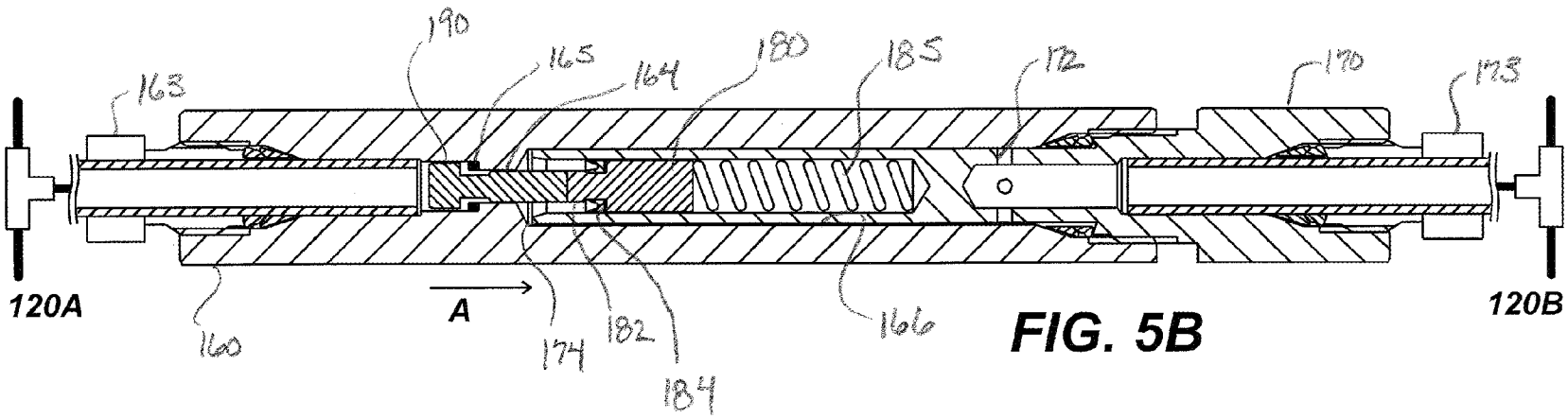

The regulator 150 is shown in a closed condition in FIG. 5A and is shown in an opened condition in FIG. 5B. As shown, the regulator 150 has a housing 160 defining an internal passage therein so that this arrangement represents the regulator 150 designed as a separate component from the safety valve (50). However, as noted previously, it will be appreciated that the regulator 150 can be part of the safety valve (50) and the regulator's housing 160 can actually be components of the safety valve (50) itself. Moreover, the housing 160 can be constructed in ways known in the art for facilitating its assembly, which may not be depicted in the drawings.

The housing 160 has a primary port 162 with a hydraulic fitting 163 for connecting to the primary control line 120A with a flow tee or the like. The primary port 162 communicates with an intermediate barrel chamber 166 through a choke passage 164. A sleeve 170 installs in the intermediate barrel chamber 166 and has a hydraulic fitting 173 for connecting to the balance control line 120B with a flow tee or the like.

A dart 190 for flow control resides in the primary port 162 and can move therein to seal against a seal or seat 165 around the choke passage 164. A piston 180 resides in the open end 174 of the sleeve 170. A spring 185 resides in an atmospheric or low pressure chamber of the sleeve 170 behind the piston 180 and biases the piston 180 outward. Depending on the hydraulic pressure acting against the piston's front end 182 and the bias of the spring 185, the piston 180 can move relative to the dart 190 and can push the dart 190 relative to the choke passage 164.

As noted previously, hydraulic pressure applied to the primary control line 120A (communicating with port 162) opens the safety valve (50) coupled to the lines 120A-B. Hydraulic pressure from control line 120A applied to the balance control line 120B until the balance line reaches its designed hydrostatic pressure. At that pressure, the communication between line 120A to line 120B will cease. The stored hydrostatic pressure in line 120B acts to offset the hydrostatic pressure from the primary control line 120A for the purposes of controlling the safety valve (50) as disclosed herein.

In the closed condition of FIG. 5A, the hydraulic pressure of the primary control line 120A pushes against the dart 190 so that it seals on the seat 165 inside the choke passage 164. On the other end of the regulator 150, hydraulic pressure from the balance control line 120B pushes the piston 180 against the bias of spring 185 so that the piston 180 does not engage the dart 190. In particular, pressure from the balance control line 120B communicates through the fitting 173 and passes out the sleeve's cross-ports 172 to communicate in the annulus around the sleeve 170 in the barrel chamber 166.

The pressure communicates to the end 174 of the sleeve 170 and enters the space between the dart 190 and the piston 180. Here, the hydraulic pressure acts against the piston's end 182 having a cup seal 184, and the pressure tends to force the piston 180 against the bias of the spring 185. The cup seal 184 can use non-elastomeric, metal-to-metal sealing systems known in the art, although any suitable sealing system could be used.

At normal conditions, the primary pressure in port 162 acting against the dart 190 is greater to or equal to the second pressure in chamber 166 acting against the dart 190 so that the dart 190 seals off flow through the regulator 150. In other words, the differential between the first and second hydraulic pressures bias the piston 182 to the released position as shown in FIG. 5A, thus allowing the dart 190 to be in the closed condition. If the balance control line 120B loses integrity and insufficient annular pressure is present to offset the primary control line's hydrostatic pressure, then the safety valve (50) as described previously can fail in the open position, which is unacceptable.

Weakening of the pressure integrity of the balance control line 120B is shown in FIG. 5B. Reduced pressure acting against the piston 180 has allowed the spring 185 to bias the piston 180 so that it now engages the end of the dart 190. If the weakening is great enough, then the piston 180 pushes the dart 190 through the choke passage 164 and away from the seal 165 as shown. (Preferably, the cup seal 184 on the piston's end 182 is not allowed to pass the edge 174 of the sleeve 170 because this could damage the seal 184 and cause it to extrude.)

Having the dart 190 moved away from the seal 165 allows pressure from the primary control line 120A to pass by the dart 190 and through choke passage 164. This action bleeds pressure from the primary control line 120A to the balance control line 120B. In this way, the regulator 150 helps the control system 100 to overcome failure of the safety valve (50) in the opened condition.

By opening as in FIG. 5B, for example, the regulator 150 ensures that the primary control line 120A at port 162 bleeds into balance line 120B, thus equalizing the hydrostatics to the safety valve (50). As hydraulic pressure bleeds through the regulator 150, the hydraulic pressure supplied by the primary line 120A to the safety valve (50) may fall below a level that allows the safety valve (50) to remain open. For instance, the force from the internal spring (56) in the valve (50), any remaining pressure in the balance control line 120B, and possibly tubing pressure, if applicable, can act to close the valve (50) as described previously. When this happens, the safety valve (50) closes and fails in the closed condition rather than staying open.

If integrity in the balance control line 120B is regained, then the hydraulic pressure in the balance line 120B can eventually move the piston 180 against the spring 185 and allow the dart 190 to seat in the closed position of FIG. 5A. Once this is done, the primary control line 120A can again be used to operate the valve (50) while the balance control line 120B provides the hydrostatic offset for deep-set operation.

For ease of explanation, the disclosed control system has been described generally in relation to a cased vertical wellbore. However, the disclosed control system can be employed in any type of well, such as an open wellbore, a horizontal wellbore, or a diverging wellbore, without departing from principles of the present disclosure. Furthermore, a land well is shown for the purpose of illustration; however, it is understood that the disclosed control system can also be employed in offshore wells.

Spring forces, hydraulic surface areas, volumes, and other details for the components disclosed herein can be suited for a particular implementation and can vary based on expected operating pressures and other considerations. Therefore, the disclosed regulator and control system can be configured to operate in response to a set and determined pressure differential for a particular implementation. With that said, the disclosed regulator and control system are intended to permit hydraulic pressure to flow from a primary control line to a balance line in response to pressure in the balance line falling below some set pressure level. In general, this set pressure level is related to the hydrostatic pressure associated with the column of hydraulic fluid in the primary control line, although the actual values of the level may be different than the precise hydrostatic pressure.

Although use of one regulator 150 between control lines 120A-B has been shown and described herein, it will be appreciated that multiple regulators 150 can be used between the control lines 120A-B. These multiple regulators 150 can be similarly configured to provide redundancy should one fail to operate. Alternatively, the various regulators 150 can be configured to operate differently in response to different hydraulic pressures in the control lines 120A-B, which in turn can have direct bearing on the safety valve's operation and the pressures it is exposed to.

Again, although the disclosed regulator 150 of FIGS. 5A-5B is shown as a separate component with its own housing 160, it will be appreciated that the regulator 150 can be incorporated into the housing of the safety valve 50 as shown in FIG. 4B or incorporated into some other downhole tubing component. For example, the control lines 120A-B can communicate with internal channels or ports that connect to an internal chamber in the safety valve's housing. Components of the regulator 150, such as sleeve 170, piston 180, spring 185, and dart 190 can install in the valve's internal chamber to regulate hydraulic pressure between the ports for the control lines 120A-B according to the purposes disclosed herein.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A hydraulic control system for a sub-surface safety valve, the system comprising:

a first control line in hydraulic communication with the sub-surface safety valve and communicating first hydraulic pressure to actuate the sub-surface safety valve;

a second control line in hydraulic communication with the sub-surface safety valve and communicating second hydraulic pressure to compensate for hydrostatic pressure associated with the first control line; and a regulator repeatedly operable between at least two repeatedly operable conditions and regulating hydraulic communication between the first and second control lines in response to a pressure differential therebetween, the regulator in at least one of the repeatedly operable conditions permitting hydraulic communication from the first control line to the second control line in response to the second hydraulic pressure falling below a pressure level related to the hydrostatic pressure associated with the first control line.

2. The system of claim 1, wherein the regulator affixes to production tubing having the sub-surface safety valve disposed thereon.

3. The system of claim 1, wherein the regulator is incorporated into the sub-surface safety valve.

4. The system of claim 1, wherein the regulator comprises a flow control repeatedly movable in the regulator between open and closed conditions, the flow control having a first portion exposed to the first hydraulic pressure and having a second portion exposed to the second hydraulic pressure.

5. The system of claim 4, wherein the regulator comprises a biasing element biasing the flow control to the opened condition.

6. The system of claim 1, wherein the regulator comprises:

a dart repeatedly movable in the regulator between open and closed conditions, and a piston repeatedly movable between engaged and unengaged conditions, the piston in the engaged condition moving the dart to the open condition, the piston in the unengaged condition permitting the dart to move to the closed condition.

7. The system of claim 6, wherein the regulator comprises a biasing element biasing the piston to the engaged condition.

8. The system of claim 6, wherein the dart in the closed condition prevents hydraulic communication from the first control line to the second control line and in the opened condition permits hydraulic communication from the first control line to the second control line.

9. The system of claim 1, wherein the first control line extends from the sub-surface safety valve through a wellhead.

10. The system of claim 9, wherein the second control line extends from the sub-surface safety valve through the wellhead.

11. The system of claim 10, wherein the first and second control lines couple to a hydraulic system.

12. The system of claim 10, wherein the second control lines extends from the sub-surface safety valve and terminates downhole from the wellhead.

13. The system of claim 1, further comprising a hydraulic system coupling to one or both of the first and second control lines.

14. The system of claim 1, further comprising a sub-surface safety valve deployable downhole, the sub-surface safety valve comprising:

a closure movable between closed and opened conditions relative to a bore in the sub-surface safety valve;

a first actuator tending to close the closure in response to the first hydraulic pressure communicated by the first control line; and a second actuator tending to act against the first actuator in response to the second hydraulic pressure communicated by the second control line.

15. A sub-surface safety valve apparatus, comprising:

a closure movable between closed and opened conditions relative to a bore in the sub-surface safety valve;

a first actuator tending to close the closure in response to first hydraulic pressure communicated by a first control line to the sub-surface safety valve;

a second actuator tending to act against the first actuator in response to second hydraulic pressure communicated by a second control line to the sub-surface safety valve; and a regulator repeatedly operable between at least two repeatedly operable conditions and regulating hydraulic communication between the first and second control lines in response to a pressure differential therebetween, the regulator in at least one of the repeatedly operable conditions permitting hydraulic communication from the first control line to the second control line in response to the second hydraulic pressure falling below a pressure level related to hydrostatic pressure associated with the first control line.

16. The apparatus of claim 15, wherein the closure comprises:

a flapper being rotatable relative to the bore; and a flow tube movable in the bore with the first and second actuators relative to the flapper.

17. The apparatus of claim 16, wherein the first and second actuators comprise first and second pistons engaging the flow tube.

18. The apparatus of claim 17, wherein the first piston couples to the flow tube and provides a first force for moving the flow tube in response to the first hydraulic pressure at least exceeding a biasing force acting against the first force on the flow tube.

19. The apparatus of claim 18, wherein the second piston couples to the flow tube and provides at least a portion of the biasing force acting against the first force.

20. The apparatus of claim 19, wherein the second piston provides the portion of the biasing force in response to the second hydraulic pressure communicated by the second control line.

21. The apparatus of claim 18, wherein a biasing element provides at least a portion of the basing force acting against the first force.

22. The apparatus of claim 18, wherein tubing pressure provides at least a portion of the biasing force acting against the first force.

23. The apparatus of claim 15, wherein the apparatus comprises a housing having the closure, the first actuator, the second actuator, and the regulator.

24. A sub-surface safety valve hydraulic control method, comprising:

actuating the sub-surface safety valve open by communicating fist hydraulic pressure to the sub-surface safety valve via a first control line;

offsetting hydrostatic pressure associated with the first control line by communicating second hydraulic pressure to the sub-surface safety valve via a second control line; and regulating a hydraulic pressure differential between the first and second control lines with at least two repeatedly operable conditions by— permitting in one of the repeatedly operable conditions hydraulic communication from the first control line to the second control line in response to the second hydraulic pressure falling below a pressure level related to the hydrostatic pressure associated with the first control line; and restricting in another of the repeatedly operable conditions hydraulic communication from the second control line to the first control line.

25. The method of claim 24, wherein restricting the hydraulic communication from the second control line to the first control line comprises biasing a differential between the first and second hydraulic pressures to a closed condition.

26. The method of claim 24, wherein communicating the second hydraulic pressure to the sub-surface safety valve via the second control line comprises actuating the sub-surface safety valve closed with the second hydraulic pressure.

27. The method of claim 24, wherein communicating the fist hydraulic pressure to the sub-surface safety valve via the first control line comprises extending the first control line through a wellhead and connecting the first control line to a hydraulic system.

28. The method of claim 27, wherein communicating the second hydraulic pressure to the sub-surface safety valve via the second control line comprises extending the second control line through the wellhead and connecting the second control line to the hydraulic system.

29. The method of claim 27, wherein communicating the second hydraulic pressure to the sub-surface safety valve via the second control line comprises terminating the second control line downhole from the wellhead and charging the second control line with the second hydraulic pressure via the first control line and the regulator.

* * * * *